US005759633A

United States Patent [19]

Baumlin et al.

[11] Patent Number: 5,759,633

[45] Date of Patent: Jun. 2, 1998

[54] METHOD FOR IMPROVING THE UNIFORMITY OF A LIQUID CURTAIN IN A CURTAIN COATING SYSTEM

[75] Inventors: Jean-Marie Baumlin, Chalon-Sur-Saone; Jeanne Danielle Mauricette Jacquinot, Crissey, both of France

[73] Assignee: Eastman Kodak Company, Rochester, N.Y.

[21] Appl. No.: 760,076

[22] Filed: Dec. 4, 1996

[30] Foreign Application Priority Data

Dec. 14, 1995 [FR] France ..... 95 15010

[51] Int. Cl.[6] ..... B05D 1/30

[52] U.S. Cl. ..... 427/444; 427/420; 118/DIG. 4

[58] Field of Search ..... 118/DIG. 4; 427/420, 427/444

[56] References Cited

U.S. PATENT DOCUMENTS

| | | | |
|---|---|---|---|
| 3,632,374 | 1/1972 | Greiller | 117/34 |
| 3,867,901 | 2/1975 | Greiller | 118/50 |
| 4,109,611 | 8/1978 | Fahrni et al. | 118/325 |
| 4,510,882 | 4/1985 | Prato | 118/300 |
| 4,877,639 | 10/1989 | Willemsens et al. | 427/13 |
| 5,338,359 | 8/1994 | Conroy et al. | 118/412 |
| 5,462,598 | 10/1995 | Servant et al. | 118/DIG. 4 |

*Primary Examiner*—Katherine A. Bareford

*Attorney, Agent, or Firm*—Clyde E. Bailey, Sr.

[57] ABSTRACT

The invention concerns a method for improving the uniformity of a liquid curtain which includes the specification of, prior to the coating of the composition under the coating conditions, forming a curtain with flow rate and viscosity conditions (1, 2) which are such that the rear face of the lip is wet over a height greater than the height over which the composition would naturally wet the rear face under the coating conditions. Then, maintaining these flow rate and viscosity conditions over a given period of time.

8 Claims, 3 Drawing Sheets

METHOD FOR IMPROVING THE UNIFORMITY OF A LIQUID CURTAIN IN A CURTAIN COATING SYSTEM

TECHNICAL FIELD

The invention concerns the field of curtain coating, and finds its application notably in the field of the coating of supports by means of a photographic composition.

BACKGROUND OF THE INVENTION

The technique of curtain coating is a technique which has already been widely used in the photographic industry. Typically, a curtain coating device comprises a feed system in the form of one or more slots fed with photographic emulsion and from which the photographic emulsion flows in the form of one or more layers which are superposed on a slightly inclined flow plane. The photographic layers then flow onto a lip, where they leave the coating device to form a liquid curtain in substantially vertical free fall, which is deposited on a moving support (driven, for example, by means of a motorized cylinder). Schematically, the lip is substantially vertical and has a front face on which the layers of photographic emulsion flow, and a rear face forming, with respect to the front face, an angle which is typically around 30° to 45°. The bottom ends of the front face and of the rear face are separated by a bevel, the width of which varies overall between 0.1 mm and 2.5 mm. For applications of this type, the flow rates (per unit width of the lip) vary from 0.6 $cm^2/s$ to 6 $cm^2/s$. The viscosity of the photographic layers varies from 0.03 to 3 poise. All these quantities are, of course, mentioned only by way of indication.

Such curtain coating systems have been the subject of numerous publications in the patent literature. By way of example, reference can be made to the patents EP-A-107 818; U.S. Pat. Nos. 4,510,882; 3,632,374; 3,867,901; and FR-A-2 346 057.

One of the problems to which such a system is sensitive (notably for photographic applications for which uniformity of coating is essential) relates to the uniformity and homogeneity of the curtain. This is because a non-uniform curtain creates streaks on the photographic product, that is to say variations in thickness across the width of the support. These variations have an appreciable effect on the photographic properties of the film and consequently it is important to minimize them as much as possible.

Various approaches have been used to minimize the problems related to the non-uniformity of the curtain. Amongst these, it has been proposed to modify the design of the coating lip, or to modify the flow rates or the viscosity of the compositions to be deposited on the support. The benefits of these solutions are often limited and are, furthermore, often obtained to the detriment of other parameters in the system.

According to U.S. Ser. No. 08/643,836 filed in the name of the applicant on May 7, 1996 and entitled METHOD AND APPARATUS FOR IMPROVING THE UNIFORMITY OF A LIQUID CURTAIN IN A CURTAIN COATING SYSTEM, the wetting of the lip is made uniform by means of a mechanical device 20 as illustrated diagrammatically in FIG. 1.

Such a mechanical device 20 principally comprises two fingers 1 and 2 mounted on a frame 3. Each of the fingers defines a first surface 4, 5 designed to be brought to bear on the front face of the lip of the coating device, and a second surface 6, 7 designed to be applied substantially to the rear face of the lip. The first surface forms, with respect to the second, an angle substantially equal to the angle formed by the front face of the lip with respect to the rear face, and is preferably disposed opposite the second. Generally, the angle between the two surfaces varies from 30° to 45°. The height of the rear surface 6, 7 of each of the fingers is at least equal to the height over which it is intended that the liquid should wet the rear face.

During operation, an operator applies the wetting device to the lip of the coating device and slides it so as to cause it to travel at least once over substantially the whole width of the lip. Thus the rear surface 6, 7 of each of the fingers is applied opposite the rear face of the lip and forces the liquid to wet the said rear face over a height greater than its natural wetting height.

SUMMARY OF THE INVENTION

Although the device described above helps to provide a satisfactory solution to the problem of the uniform wetting of the lip, it does however present certain drawbacks, mainly related to the fact that the curtain is disturbed mechanically.

Thus one of the objects of the present invention is to provide a method which appreciably improves the uniformity of a liquid curtain in a curtain coating device.

Other objects of the present invention will emerge in detail in the description that follows.

The invention therefore proposes a simple method which affords a substantial improvement to the uniformity of the wetting of the rear face of the lip.

According to a first aspect of the invention, a method is produced for improving the uniformity of a curtain in a system for coating a moving support with a coating composition, with given coating conditions of flow rate and viscosity, the coating system comprising a lip having a front face and a rear face, the method consisting of:

a) prior to the coating of the composition under the coating conditions, forming a curtain with flow rate and viscosity conditions which are such that the rear face of the lip is wet over a height greater than the height over which the composition would naturally wet the said rear face under the said coating conditions;

b) maintaining these flow rate and viscosity conditions over a given period of time.

Advantageously, the method comprises the following steps:

a) forming a liquid curtain by means of a liquid composition with a high flow rate and low viscosity;

b) progressively reducing the flow rate of the liquid composition so that the rear face of the lip is wet over a given period of time, over a height greater than the height over which the coating composition would naturally wet the said rear face under the coating conditions;

c) progressively replacing the liquid composition with the said coating composition while substantially maintaining the flow rate at its value determined in b);

d) increasing the flow rate so as to give the said given coating conditions.

Advantageously, the liquid composition is water.

BRIEF DESCRIPTION OF THE DRAWINGS

In the description that follows, reference will be made to the drawings in which.

DESCRIPTION OF THE PREFERRED EMBODIMENTS

The invention is the result of the observation that if, prior to the coating of a composition under given coating conditions, a curtain is formed with flow rate and viscosity conditions which are such that the rear face of the lip is wet over a height greater than the height over which the composition would naturally wet the rear face under the coating conditions, and if these flow rate and viscosity conditions are maintained over a given period of time (typically, above 1 second), a substantially uniform wetting of the rear face is then obtained when then changing to the coating conditions, thereby reducing substantially the appearance of standing streaks in the curtain liable to create physical defects on the coated support.

Figure 1:
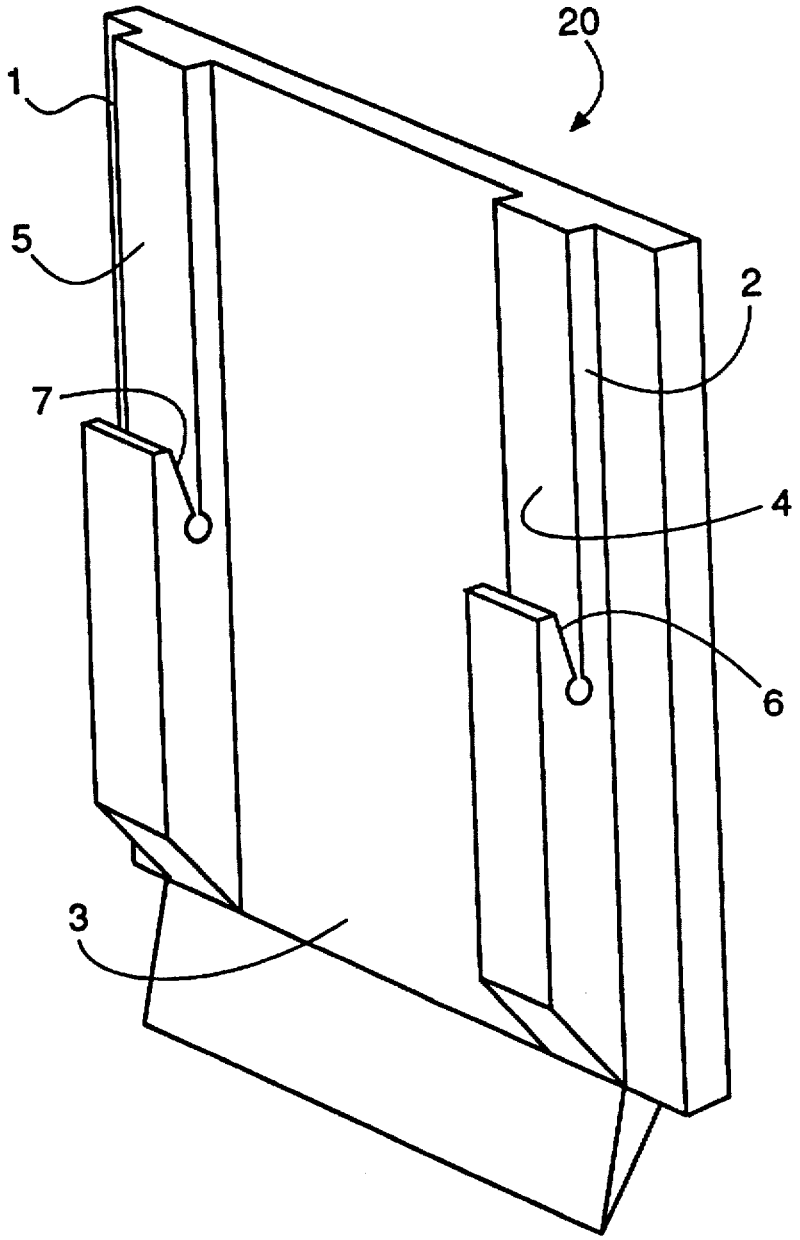
FIG. 1 (PRIOR ART)
FIG. 1 depicts a mechanical device used in the prior art to improve the uniformity of a liquid curtain.
Figure 2:
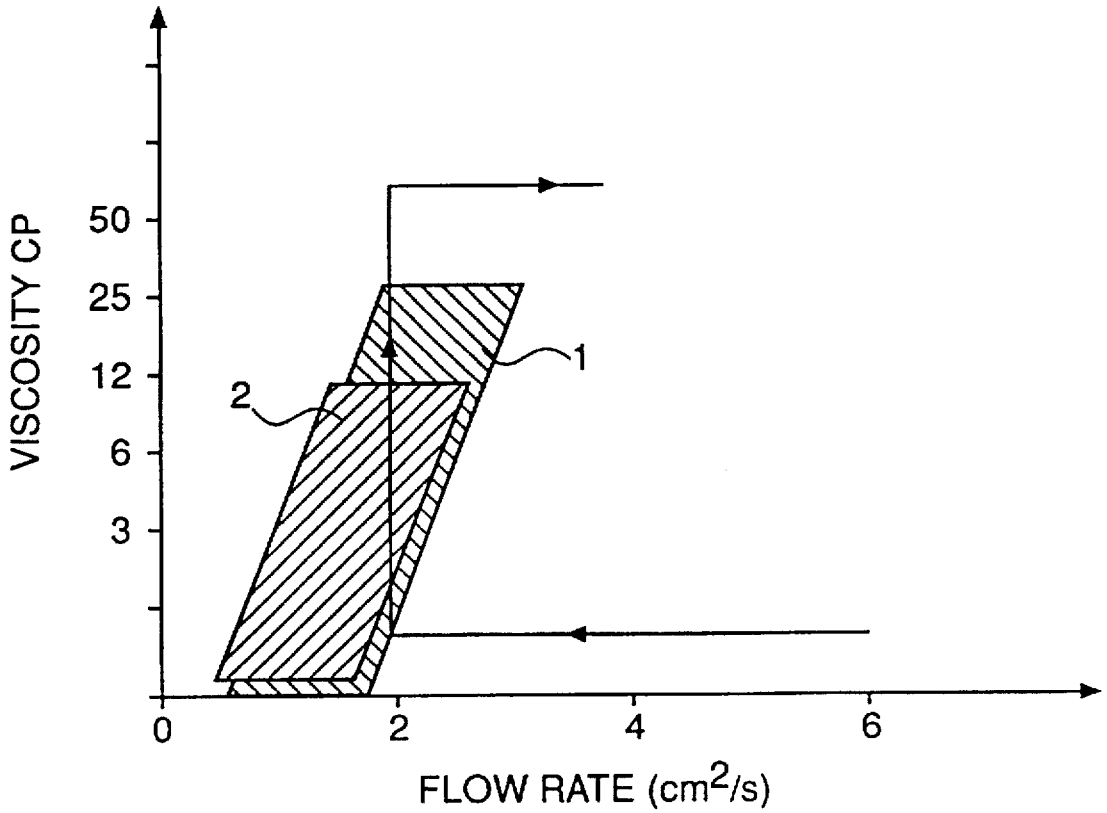
FIG. 2 illustrates a first example embodiment of the method according to the invention.

FIG. 2 illustrates diagrammatically a first embodiment of the method according to the present invention. According to this first example, the coating composition is a photographic composition whose viscosity is greater than $50\times10^{-2}$ P with a flow rate of around 4 $cm^2/s$.

According to this embodiment, there is initially a liquid composition with a high flow rate (6 $cm^2/s$) and a low viscosity ($6.5\times10^{-3}$ P, which typically corresponds to water at 40° C. to which surfactants are added to facilitate the formation of the curtain). The flow rate is reduced (1.5 to 2 $cm^2/s$) so as to attain the flow rate level of the wettability window 1 defining a flow rate and viscosity region within which the liquid composition wets the rear face of the lip over a height greater than the natural wetting height over which the coating composition would wet under the coating conditions referred to above. By way of example, the wettability window corresponds to a range of flow rates between 1 $cm^2/s$ and 3 $cm^2/s$, and preferably between 1.5 $cm^2/s$ and 2.5 $cm^2/s$. The corresponding viscosity range is between $6.5\times10^{-3}$ P and 0.5 P and preferably between 0.03 P and 0.5 P. Typically, the wetting height under these flow rate and viscosity conditions is around 0.6 mm. There is then a progressive change from water to the photographic composition, while the flow rate is held substantially at the reduced value. The change from water to the photographic composition results in an increase in viscosity, which takes place progressively so that the process stays within the wettability window for a sufficiently long period (generally longer than 1 second). The viscosity of the coating composition continues to increase outside the conditions of the wettability window. The flow rate is then increased to attain the coating rate (around 4 $cm^2/s$ according to this specific example). The wetting of the rear face of the lip remains uniform and has an average height of around 0.1 mm. The waves initially present in the curtain at the lip disappear when the flow rate is reduced and do not reappear when the flow rate is thereafter taken to a higher rate.

The location and size of the wettability window are, to a large extent, dependent on the characteristics of the lip, and notably its geometry. For each type of lip there is a corresponding window (see windows 1 and 2 in FIG. 2 by way of example).

The wetting height is measured, and more generally the wettability window for a given lip configuration is determined, experimentally by using an endoscope for example.

The advantage of the embodiment that has just been described lies in the fact that the water used to clean the emulsion feed circuit following a previous coating process, some of which has remained in the pipework of the circuit, is advantageously used according to the invention to produce the uniform wetting of the rear face of the lip for a new coating, thereby limiting losses of coating composition.

Figure 3:
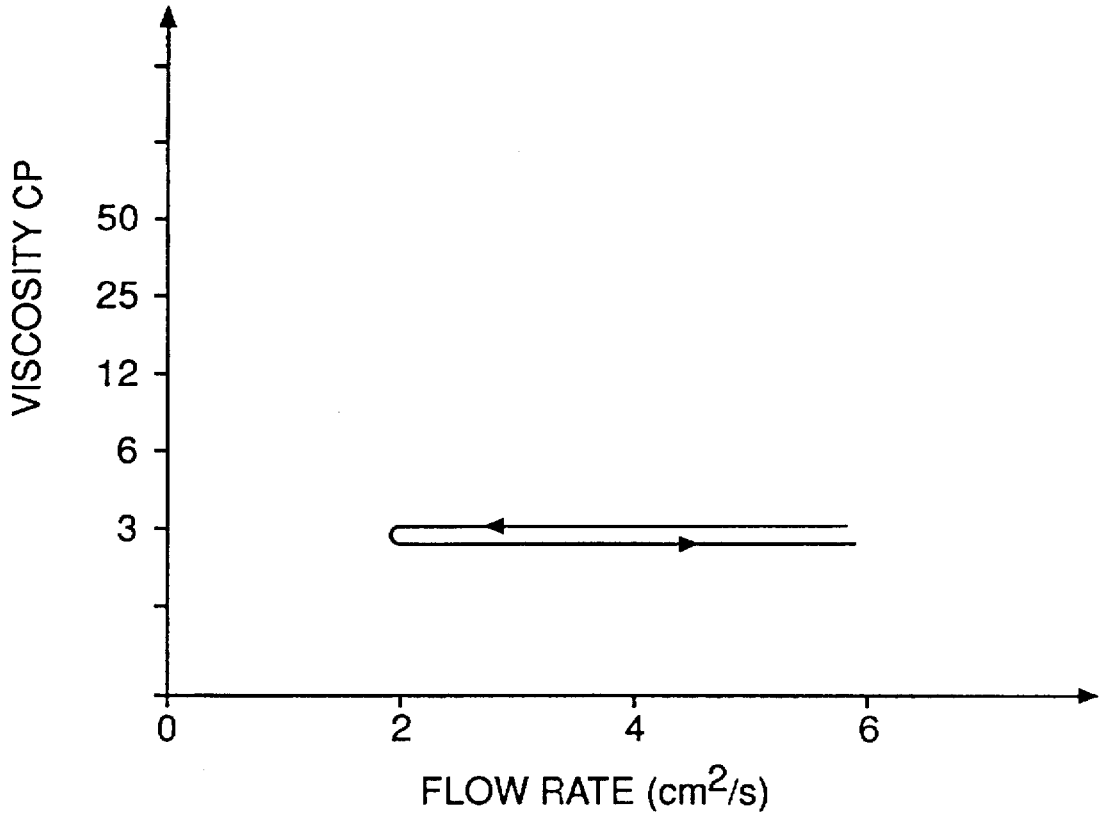
FIG. 3 illustrates a second example embodiment of the method according to the invention.

According to a second embodiment of the present invention, a solution of gelatin and surfactant whose viscosity is 0.03 P is used. Initially, the curtain is established with a high flow rate (around 6 $cm^2/s$). The rate is then reduced to about 1.5 $cm^2/s$, producing a significant wetting of the rear face of the lip. These conditions are maintained for a few seconds, and the flow rate is again brought to 6 $cm^2/s$. The uniformity of the curtain is evaluated by looking at the reflection of daylight in the curtain. Waves appear at the start, at the lip, and then disappear when the flow rate is reduced to 1.5 $cm^2/s$. It is then checked, over 8 hours at a flow rate of 4 $cm^2/s$, that the waves do not reappear. The implementation of this example is illustrated in FIG. 3.

The same flow rate variation profile was produced with a liquid composition whose viscosity is 0.3 P. A disappearance of waves is also observed at the lip. Likewise, these waves do not reappear when the flow rate is brought to its high value.

According to another example embodiment, the flow rate and viscosity conditions are modified by means of a coating configuration with two superposed layers. The respective flow rates and viscosities of the two layers are illustrated in the following table. The layer indicated "bottom" designates the layer in contact with the flow surface of the composition feed device. The layer indicated "top" designates the one in contact with the air.

| | 1 | 2 | 3 | 4 |
|---|---|---|---|---|
| | irregular wetting. height = 0.2 mm | | uniform wetting (0.6 mm) | uniform wetting (0.1 mm) |
| "bottom" layer viscosity | 0.023 P | 0.023 P | 0.023 P | 0 |
| "top" layer viscosity | 0.3 P | 0.3 P | 0.3 P | 0.3 P |
| "bottom" layer flow rate | 0.7 $cm^2/s$ | 0.7 $cm^2/s$ | 0.7 $cm^2/s$ | 0 |
| "top" layer flow rate | 5.3 $cm^2/s$ | 3.3 $cm^2/s$ | 0.8 $cm^2/s$ | 4 $cm^2/s$ |

A curtain is formed under the conditions shown in column 1 of the above table. The flow rate conditions of the layers are changed as indicated in the other columns 2 to 4, going from the left of the table to the right.

As is clearly seen from the above table, the changes in viscosity and flow rate are effected by eliminating the bottom layer with low viscosity. As regards the top layer, the initial flow rate is high; the average height of the wetting of the rear face of the lip is around 0.2 mm; it is irregular, giving rise to waves at the lip of the coating device. Thereafter, the flow rate and viscosity are low for at least one second (column 3). The wetting of the lip is high (0.6 mm); the waves have disappeared. The bottom layer is then eliminated; the flow rate of the top layer is brought to its high value (column 4); the wetting is uniform over a height of around 0.1 mm; no wave reappears in the curtain.

The invention that has just been described is particularly advantageous in that it affords a uniform wetting of the lip without manual and/or mechanical intervention in the curtain.

The invention has just been described with reference to preferred embodiments of the invention. It is obvious that variants can be made thereto without departing from the spirit of the invention as claimed hereinafter.

What is claimed is:

1. Method for improving uniformity of a curtain in a system for coating a moving support with a coating composition, with defined coating conditions of flow rate and viscosity, said coating system comprising a lip having a front face on which the coating composition flows and a rear face, comprising, prior to the coating of the composition under the defined coating conditions, the sequential steps of:

a) forming a liquid curtain by flowing the coating composition over the front face of the lip; the coating composition having a sufficient flow rate to form a liquid curtain;

b) while flowing coating composition over the front face of the lip, progressively reducing the flow rate of the coating composition to a set value so that the rear face of the lip is wet over a height of the rear face from the lip greater than the one obtained by the coating composition flowing over the front face of the lip under said defined coating condition;

c) maintaining the flow rate at the set value over a defined period of time; and d) increasing the flow rate so as to give said defined coating conditions.

2. Method according to claim 1, characterized in that said defined period of time is greater than 1 second.

3. Method according to claim 1, characterized in that said coating composition is a photographic composition.

4. Method according to claim 1, wherein said defined coating conditions include a flow rate between 1 $cm^2/s$ and 3 $cm^2/s$ and a viscosity between $6.5\times10^{-3}$ P and 0.5 P.

5. Method according to claim 1, wherein said defined coated conditions include a flow rate between 1.5 $cm^2/s$ and 2.5 $cm^2/s$ and a viscosity between 0.03 P and 0.5 P.

6. Method for improving uniformity of a curtain in a system for coating a moving support with a coating composition, with defined coating conditions of flow rate and viscosity, said coating system comprising a lip having a front face on which the coating composition flows and a rear face, comprising, prior to the coating of the composition under the defined coating conditions, the sequential steps of:

a) forming a liquid curtain by flowing a liquid composition different from the coating composition over the front face of the lip; the liquid composition having a sufficient flow rate to form a liquid curtain and a viscosity less than the viscosity of the defined coating conditions;

b) while flowing liquid composition over the front face of the lip, progressively reducing the flow rate of the liquid composition to a set value so that the rear face of the lip is wet over a height of the rear face from the lip greater than the one obtained by the coating composition flowing over the front face of the lip under said defined coating conditions;

c) maintaining the flow rate at the set value over a defined period of time;

d) progressively replacing the liquid composition with said coating composition while substantially maintaining the flow rate at its set value; and e) increasing the flow rate of the coating composition so as to give said defined coating conditions.

7. Method according to claim 6, characterized in that said liquid composition is water.

8. Method for improving uniformity of a curtain in a system for coating a moving support with a coating composition, with defined coating conditions of flow rate and viscosity, said coating system comprising a lip having a front face on which the coating composition flows and a rear face, said method consisting, prior to the coating of the composition under the defined coating conditions, of the sequential steps of:

a) obtaining a curtain by flowing over the front face of the lip the coating composition and a bottom layer placed between the coating composition and the front face of the lip; the coating composition and the bottom layer having a sufficient flow rate to form the curtain and the bottom layer having a viscosity less than the viscosity of the defined coating conditions;

b) while flowing the coating composition and the bottom layer over the front face of the lip, progressively reducing the flow rate of the coating composition to a set value so that the rear face of the lip is wet over a height of the rear face from the lip greater than the one obtained by the coating composition flowing over the front face of the lip under said defined coating conditions;

c) maintaining the flow rate of the coating composition at the set value over a defined period of time;

d) increasing the flow rate of the coating composition so as to give said defined coating conditions for coating the support while eliminating the bottom layer.

* * * * *